US006126532A

United States Patent [19]

Sevilla et al.

[11] Patent Number: 6,126,532

[45] **Date of Patent: *Oct. 3, 2000**

[54] POLISHING PADS FOR A SEMICONDUCTOR SUBSTRATE

[75] Inventors: Roland K. Sevilla, Aurora; Frank B. Kaufman, Geneva; Sriram P. Anjur, Aurora, all of Ill.

[73] Assignee: Cabot Corporation, Boston, Mass.

[ * ] Notice: This patent is subject to a terminal disclaimer.

[21] Appl. No.: 09/114,003

[22] Filed: Jul. 10, 1998

Related U.S. Application Data

[63] Continuation-in-part of application No. 09/062,327, Apr. 17, 1998.

[60] Provisional application No. 60/045,646, Apr. 18, 1997, and provisional application No. 60/052,565, Jul. 15, 1997.

[51] Int. Cl.[7] ..... B24D 7/22

[52] U.S. Cl. ..... 451/526; 51/283

[58] Field of Search ..... 451/526; 51/283

[56] References Cited

U.S. PATENT DOCUMENTS

| | | | |
|---|---|---|---|
| 3,763,054 | 10/1973 | Reischl et al. . | |
| 3,835,212 | 9/1974 | Piacente . | |
| 3,917,761 | 11/1975 | Scheuerlein et al. . | |
| 3,942,903 | 3/1976 | Dickey et al. . | |
| 4,247,498 | 1/1981 | Castro . | |
| 4,256,845 | 3/1981 | Morris et al. . | |
| 4,519,909 | 5/1985 | Castro . | |
| 4,664,683 | 5/1987 | Degen et al. . | |
| 4,708,839 | 11/1987 | Bellet et al. . | |
| 4,728,552 | 3/1988 | Jensen, Jr. . | |
| 4,828,772 | 5/1989 | Lopatin et al. . | |
| 4,841,680 | 6/1989 | Hoffstein et al. | 51/283 |
| 4,880,843 | 11/1989 | Stein . | |
| 4,927,432 | 5/1990 | Budinger et al. . | |
| 4,954,141 | 9/1990 | Takiyama et al. . | |
| 5,019,311 | 5/1991 | Koslow . | |
| 5,020,283 | 6/1991 | Tuttle . | |
| 5,197,999 | 3/1993 | Thomas . | |
| 5,212,910 | 5/1993 | Breivogel et al. . | |
| 5,216,843 | 6/1993 | Breivogel et al. . | |
| 5,230,579 | 7/1993 | Klawson et al. . | |
| 5,232,875 | 8/1993 | Tuttle et al. . | |
| 5,257,478 | 11/1993 | Hyde et al. . | |
| 5,297,364 | 3/1994 | Tuttle . | |
| 5,329,734 | 7/1994 | Yu . | |
| 5,394,655 | 3/1995 | Allen et al. . | |
| 5,422,377 | 6/1995 | Aubert . | |

(List continued on next page.)

FOREIGN PATENT DOCUMENTS

| | | |
|---|---|---|
| 25 56 448 | 6/1977 | Germany . |
| 65-58475 | 3/1989 | Japan . |
| 3-098759 | 4/1991 | Japan . |
| 3-1938332 | 8/1991 | Japan . |
| WO 94/04599 | 3/1994 | WIPO . |
| WO 96/15887 | 5/1996 | WIPO . |

OTHER PUBLICATIONS

Patent Abstracts of Japan, vol. 15, No. 464 (E–1137) Nov. 25, 1991 & JP 03 1938332 A (NEC Corp) Aug. 29, 1991.

Patent Abstracts of Japan, vol. 15, No. 279 (M–1136) Jul. 16, 1991 & JP 03 098759 A (Nec Corp) Apr. 24, 1991.

Bayer Corporation, *A Guide to Engineering Properties*, Texin and Desmopan Thermoplaxtic Polyurethane Elastomers.

Brochure, Rodel Wafer Polishing Systems Slurries, Pads Mounting Assemblies.

Brochure, Rodel Planarization Systems Slurries, Pads, Fixturing.

Brochure, Hoechst Celanese, Porous Products from Hostalen® Gur.

*Primary Examiner*—David A. Scherbel
*Assistant Examiner*—Anthony Ojini

[57] ABSTRACT

A polishing pad for polishing a semiconductor wafer which includes an open-celled, porous substrate having sintered particles of synthetic resin. The porous substrate is a uniform, continuous and tortuous interconnected network of capillary passage. The pores of the porous substrate have an average pore diameter of from about 5 to about 100 microns which enhances pad polishing performance.

18 Claims, 9 Drawing Sheets

U.S. PATENT DOCUMENTS 5,432,100 7/1995 Smith et al. .
5,453,312 9/1995 Haas et al. ..... 428/143
5,489,233 2/1996 Cook et al. .
5,533,923 7/1996 Shamouilian et al. .
5,554,064 9/1996 Breivogel et al. .
5,562,530 10/1996 Runnels et al. .
5,578,362 11/1996 Reinhardt et al. .
5,605,760 2/1997 Roberts .
5,609,719 3/1997 Hempel .
5,611,943 3/1997 Cadien et al. .

POLISHING PADS FOR A SEMICONDUCTOR SUBSTRATE

This application is a continuation-in-part of U.S. patent application Ser. No. 09/062,327 filed on Apr. 17, 1998 which in turn claimed priority to provisional patent application No. 60/045,646 filed on Apr. 18, 1997 and to provisional patent application No. 60/052,565 filed on Jul. 15, 1997.

BACKGROUND OF THE INVENTION

1. Field of the Invention.

This invention relates to a polishing pad used for the grinding, lapping, shaping and polishing of semiconductor substrates, wafers, metallurgical samples, memory disk surfaces, optical component, lenses, wafer masks and the like. More particularly, the present invention relates to polishing pads used in the chemical mechanical polishing of a semiconductor substrate and methods for their use.

2. Discussion of the Related Art.

A semiconductor wafer typically includes a substrate, such as a silicon or gallium arsenide wafer, on which a plurality of integrated circuits have been formed. Integrated circuits are chemically and physically integrated into a substrate by patterning regions in the substrate and layers on the substrate. The layers are generally formed of materials having either a conductive, insulating or semiconducting nature. In order for a device to have high yields, it is crucial to start with a flat semiconductor wafer and, as a result, it is often necessary to polish a semiconductor wafer. If the process steps of device fabrication are performed on a wafer surface that is not planar, various problems can occur which may result in a large number of inoperable devices. For example, in fabricating modern semiconductor integrated circuits, it is necessary to form conductive lines or similar structures above a previously formed structure. However, prior surface formation often leaves the top surface topography of a wafer highly irregular, with bumps, areas of unequal elevation, troughs, trenches and other similar types of surface irregularities. Global planarization of such surfaces is necessary to ensure adequate depth of focus during photolithography, as well as removing any irregularities and surface imperfections during the sequential stages of the fabrication process.

Although several techniques exist to ensure wafer surface planarity, processes employing chemical mechanical planarization or polishing techniques have achieved widespread usage to planarize the surface of wafers during the various stages of device fabrication in order to improve yield, performance and reliability. In general, chemical mechanical polishing ("CMP") involves the circular motion of a wafer under a controlled downward pressure with a polishing pad saturated with a conventional, typically chemically-active, polishing slurry.

Typical polishing pads available for polishing applications, such as CMP, are manufactured using both soft and rigid pad materials and may be classified in three groups: polymer-impregnated fabrics; microporous films and cellular polymer foams. For example, a pad containing a polyurethane resin impregnated into a polyester non-woven fabric is illustrative of the first group. Such pads, illustrated in FIGS. 1 and 2, are commonly manufactured by preparing a continuous roll or web of fabric; impregnating the fabric with the polymer, generally polyurethane; curing the polymer; and cutting, slicing and buffing the pad to the desired thickness and lateral dimensions.

Polishing pads of the second group, are shown in FIGS. 3 and 4 and consist of microporous urethane films coated onto a base material which is often an impregnated fabric of the first group. These porous films are composed of a series of vertically oriented closed end cylindrical pores.

Polishing pads of the third group are closed cell polymer foams having a bulk porosity which is randomly and uniformly distributed in all three dimensions. An example of such a pad is represented in FIGS. 5 and 6. The volume porosity of closed cells polymer foams is typically discontinuous, thereby inhibiting bulk slurry transport. Where slurry transport is desired, the pads are artificially textured with channels, grooves or perforations to improve lateral slurry transport during polishing. For a more detailed discussion of the three main groups of polishing pads, their benefits and disadvantages, see International Publication No. W096/15887, the specification of which is incorporated herein by reference. Other representative examples of polishing pads are described in U.S. Pat. Nos. 4,728,552, 4,841,680, 4,927,432, 4,954,141, 5,020,283, 5,197,999, 5,212,910, 5,297,364, 5,394,655 and 5,489,233, the specifications of which are also each incorporated herein in their entirety by reference.

In order for CMP and other polishing techniques to provide effective planarization, slurry delivery and distribution to the polishing surface becomes important. For many polishing processes, especially those operating at high rotational speeds or pressures, inadequate slurry flow across the polishing pad may give rise to non-uniform polishing rates, poor surface quality across the substrate or article, or deterioration of the polishing pad. As a result, various efforts have been made to improve slurry delivery. For example, U.S. Pat. No. 5,489,233 to Cook et al. discloses the use of large and small flow channels to permit transport of slurry across the surface of a solid polishing pad. U.S. Pat. No. 5,533,923 to Shamouillian et al. discloses a polishing pad constructed to include conduits which pass through at least a portion of the polishing pad to permit flow of the polishing slurry. Similarly, U.S. Pat. No. 5,554,064 to Breivogel et al. describes a polishing pad containing spaced apart holes to distribute slurry across the pad surface. Alternatively, U.S. Pat. No. 5,562,530 to Runnels et al. disclosed a pulsed-forced system that allows for the down force holding a wafer onto a pad to cycle periodically between minimum (i.e. slurry flows into space between the wafer and pad) and maximum values (slurry squeezed out allowing for the abrasive nature of the pad to erode the wafer surface). U.S. Pat. Nos. 5,489,233, 5,533,923, 5,554,064 and 5,562,530 are each incorporated herein by reference.

Although known polishing pads are suitable for their intended purpose, a need remains for an improved polishing pad which provides effective planarization across an IC substrate, especially for use in CMP processes. In addition, there is a need for polishing pads having improved polishing efficiency, (i.e. increased removal rates), improved slurry delivery (i.e. high and uniform degree of permeability of slurry throughout pad in all directions), improved resistance to corrosive etchants, and localized uniformity across the substrate. There is also a need for polishing pads that can be conditioned by multiple pad conditioning methods and that can be reconditioned many times before having to be replaced.

SUMMARY OF THE INVENTION

The present invention relates to a polishing pad which includes an open-celled, porous substrate having sintered particles of synthetic resin. The porous substrate is characterized by a uniform, continuous and tortuous, interconnected network of capillary passages.

The present invention also relates to a polishing pad having a top surface and a bottom surface and which is open celled and which has a skin layer on the bottom surface but not on the top surface wherein the cells are connected throughout the pad from the top surface until they reach the bottom surface skin layer.

The present invention also relates to a polishing pad that does not swell in the presence of water, acids or alkali and wherein the pad top surface can be rendered to be readily wettable.

Furthermore, the present invention is a polishing pad having a bottom surface that is essentially impermeable to polishing slurries.

In addition, the present invention is a polishing pad having an average pore diameter that is capable of polishing IC wafers at high rates with low non-uniformity.

Also, this invention is a polishing pad with an improved pad/adhesive interface.

The polishing pad of the present invention is useful in a wide variety of polishing applications and, in particular, chemical mechanical polishing applications and provides effective polishing with minimum scratching and defects. Unlike conventional polishing pads, the polishing pad may be used on a variety of polishing platforms, assures controllable slurry mobility, and provides quantifiable attributes directly affecting polishing performance and control of the semiconductor manufacturing process for specific applications.

In particular, the polishing pad of the present invention may be used during the various stages of IC fabrication in conjunction with conventional polishing slurries and equipment. The pad provides a means for maintaining a slurry flow which is uniform across the surface of the pad.

In one embodiment this invention is a polishing pad substrate. The polishing pad substrate includes sintered particles of thermoplastic resin. The polishing pad substrate has a top surface and a bottom surface skin layer, and the pad top surface has an mean unbuffed surface roughness that is greater than the mean unbuffed surface roughness of the pad skin layer.

In another embodiment, this invention is a sintered urethane resin polishing pad substrate having a top surface, a bottom surface having a skin layer, a thickness of from 30–125 mils, a density of from 0.60 to 0.95 gm/cc, a pore volume of from 15–70%, a mean top surface roughness of from 1–50 microns and a mean bottom surface skin layer roughness of less than 20 microns wherein the mean surface roughness of the bottom surface skin layer is less than the mean surface roughness of the top surface.

In still another embodiment, this invention is a polishing pad. The polishing pad includes a polishing pad substrate that includes sintered particles of thermoplastic resin. The polishing pad substrate has a top surface and a bottom surface skin layer, and the pad top surface has an mean unbuffed surface roughness that is greater than the mean unbuffed surface roughness of the pad bottom surface. The polishing pad also includes a backing sheet, and an adhesive located between the backing sheet and the bottom surface skin layer.

DETAILED DESCRIPTION OF THE INVENTION

Figure 1:
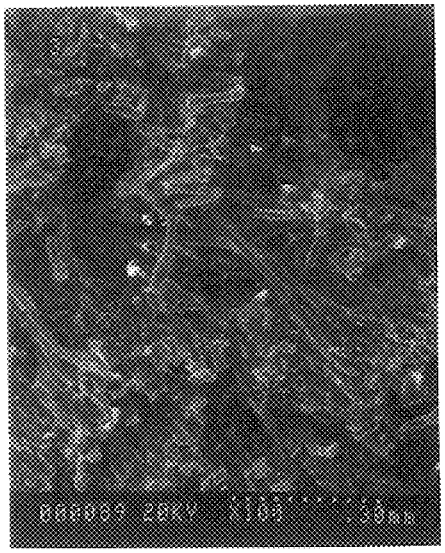
FIG. 1 PRIOR ART
FIG. 1 is a scanning electron micrograph (SEM) of the top view of a commercially available polymer-impregnated polishing pad of the prior art at 100×magnification.
Figure 2:
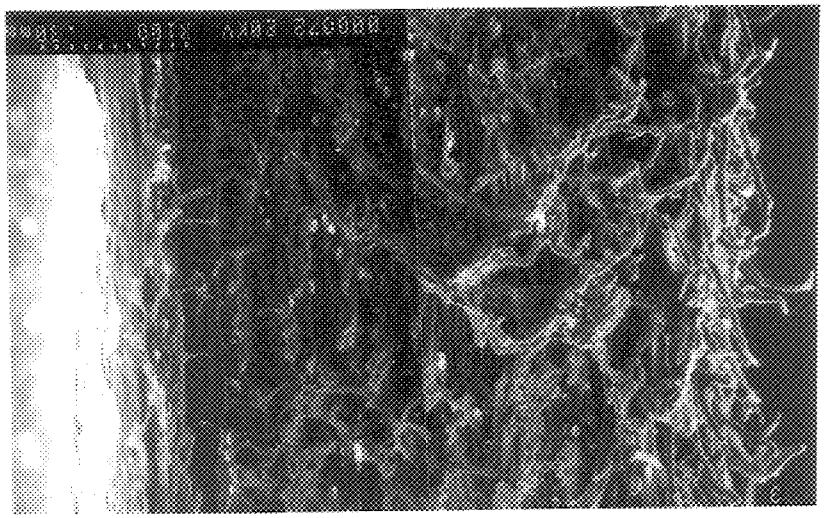
FIG. 2 PRIOR ART
FIG. 2 is a SEM of the cross-sectional view of a commercially available polymer-impregnated polishing pad of the prior art at 100×magnification.
Figure 4:
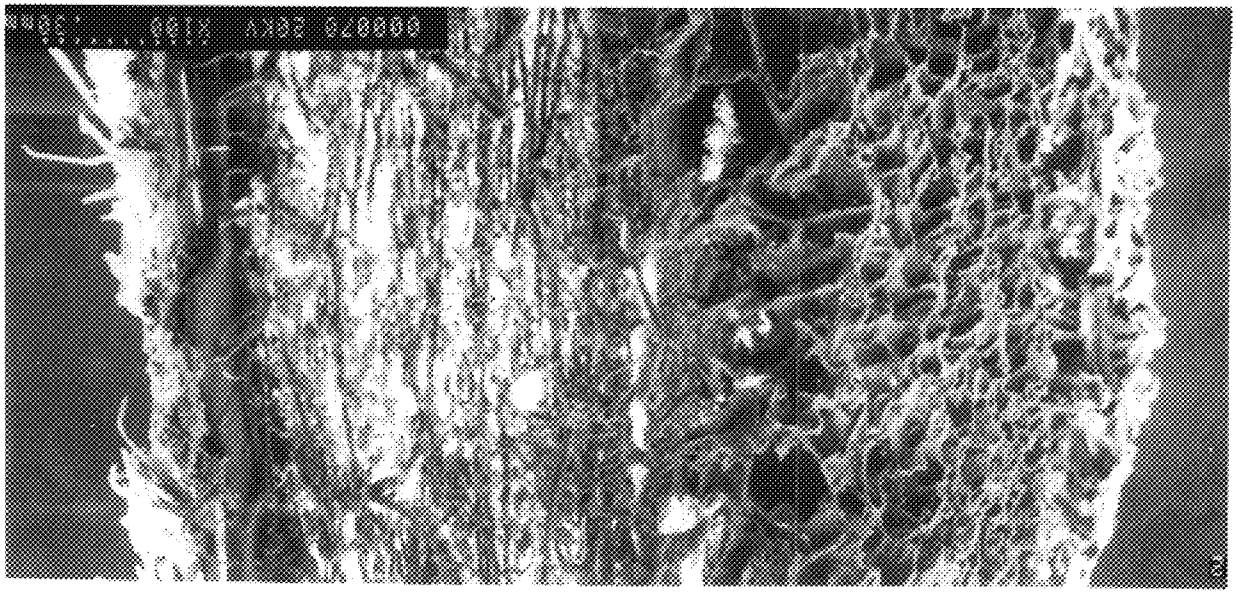
FIG. 4 PRIOR ART
FIG. 4 is a SEM of the cross-sectional view of a commercially available microporous film-type polishing pad of the prior art at 100×magnification.
Figure 3:
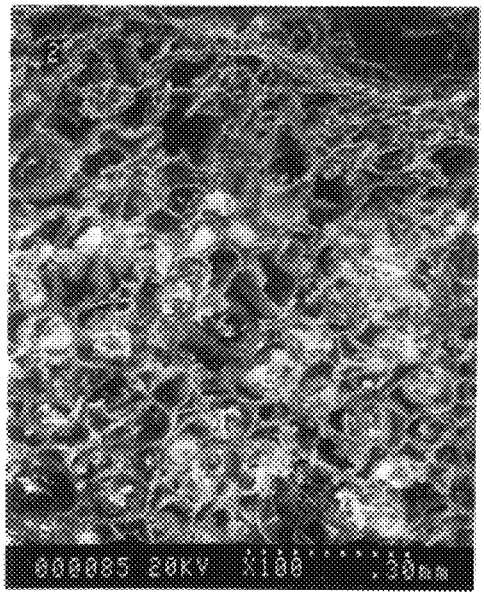
FIG. 3 PRIOR ART
FIG. 3 is a SEM of the top view of a commercially available microporous film-type polishing pad of the prior art at 100×magnification.
Figure 6:
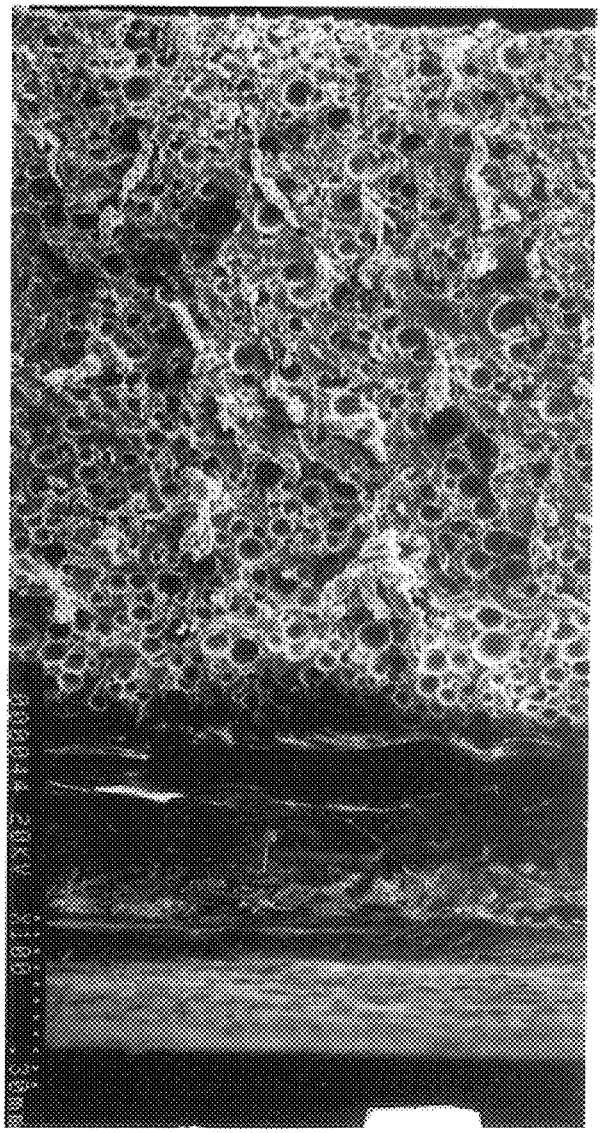
FIG. 6 PRIOR ART
FIG. 6 is a SEM of the cross-sectional view of a commercially available cellular polymer foam-type polishing pad of the prior art at 100×magnification.
Figure 5:
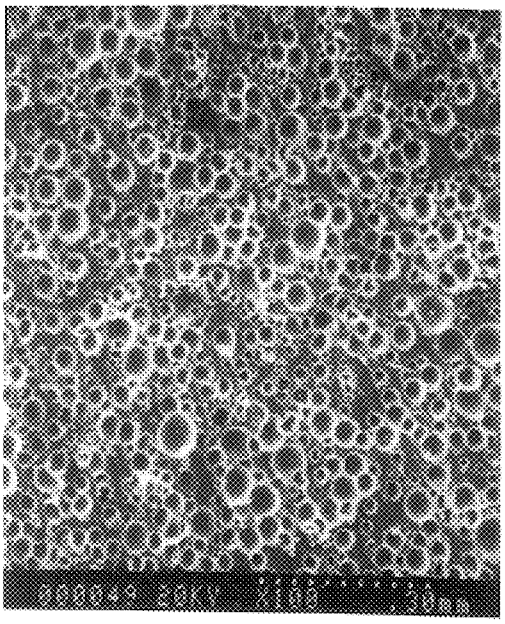
FIG. 5 PRIOR ART
FIG. 5 is a SEM of the top view of a commercially available cellular polymer foam-type polishing pad of the prior art at 100×magnification.
Figure 7:
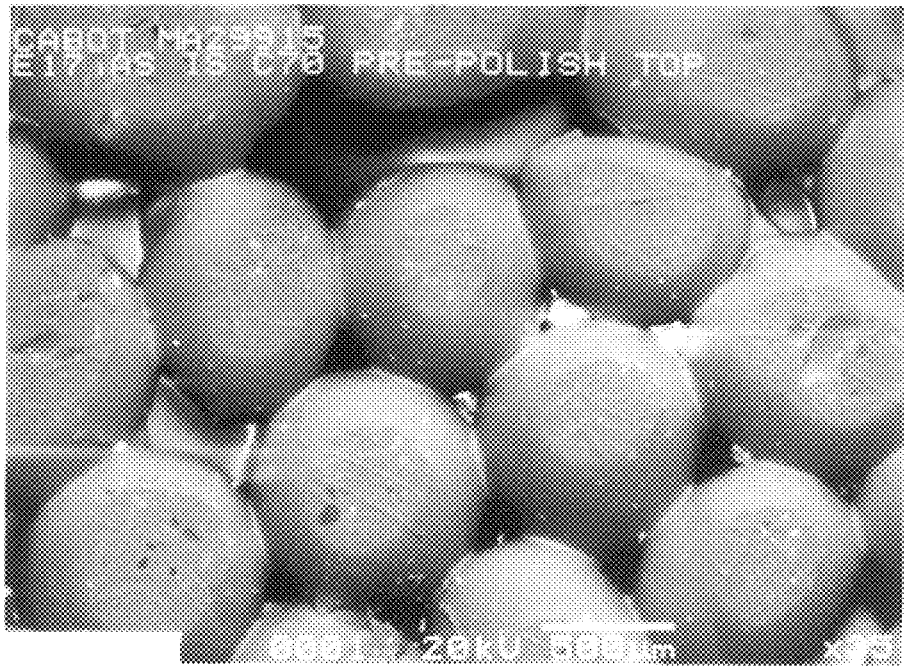
FIG. 7 is a SEM of the top view of a sintered thermoplastic resin polishing pad manufactured with 12–14 mil urethane resin spheres in a mold sintering process at 35×magnification.
Figure 8:
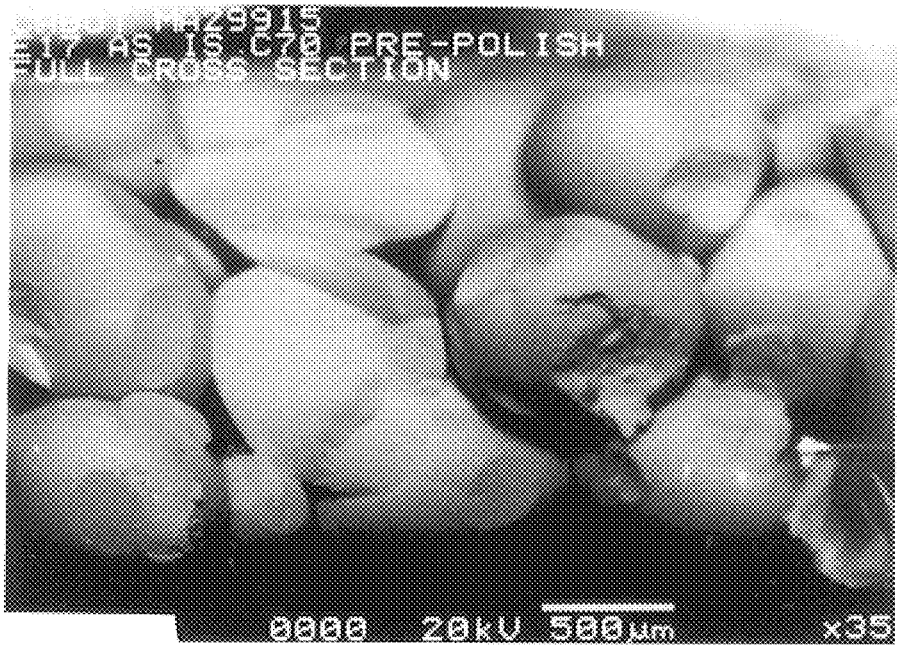
FIG. 8 is a SEM of the cross-sectional view of the polishing pad of FIG. 7 at 35×magnification.
Figure 9:
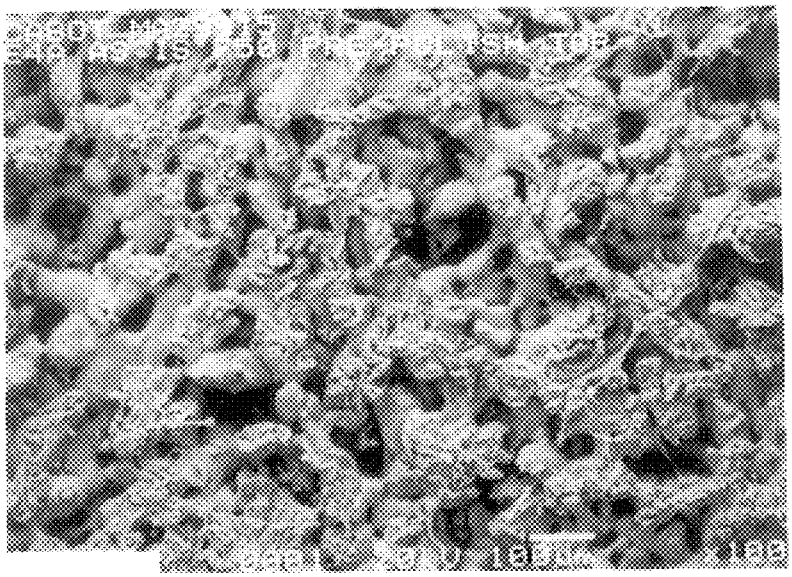
FIG. 9 is a SEM of the top view of another embodiment of a polishing pad of the present invention at 100× magnification.

The present invention relates to a polishing pad which includes an open-celled, porous substrate comprising sintered particles of synthetic resin. The pores of the substrate are characterized as having a uniform, continuous and tortuous, interconnected network of capillary passages. By "continuous" it is meant that the pores are interconnected throughout the pad except at the bottom surface where an essentially impervious bottom skin layer forms during the low pressure sintering process. The porous polishing pad substrate is microporous, i.e. pores are so small that they can be seen only with the aid of a microscope. In addition, the pores are distributed throughout the pad in all directions, as illustrated in FIGS. 7–13. Furthermore, the pad top surface is readily wettable and, when manufactured out of a preferred urethane thermoplastic, the polishing pad is nonswelling in the presence of water, acids or alkali. It is also preferred that the pad be manufactured from a single material so that it is homogeneous in composition and it should not contain unreacted thermoplastic precursor compounds.

The polishing pad substrates of the present invention are prepared utilizing a thermoplastic sintering process that applies minimal or no pressure beyond atmospheric pressure to achieve the desired pore size, porosity, density and thickness of the substrate. The term "minimal or no pressure" means less than or equal to 90 psi and preferably less than or equal to 10 psi. It is most preferred that the thermoplastic resin is sintered at essentially ambient pressure conditions. Although dependent on the type and size of synthetic resin used, the polishing pad substrate can have an average pore diameter between 1 $\mu$m and 1000 $\mu$m. Typically, the average pore diameter of the polishing pad substrate will range from about 5 to about 150 $\mu$m. In addition, a porosity, i.e. pore volume, between about 15% and about 70%, preferably between 25% and 50%, has been found to yield acceptable polishing pads possessing the necessary flexibility and durability in use.

We have now determined that sintered urethane pads having an average pore diameter of from about 5 microns to about 100 microns, and most preferably between about 10 microns to about 70 microns are excellent in polishing IC wafers and give polished wafers with very little surface defectivity. An important polished wafer surface non-uniformity quality parameters is within wafer non-uniformity ("WIWNU"). WIWNU of a tungsten wafer is reported as a percentage. It is calculated by dividing the standard deviation of removal rate by the average removal rate over the wafer and the quotient is then multiplied by 100. The removal rates were measured at 49 points along the diameter of the wafer with 3 mm edge exclusion. The measurements were made on a Tencor RS75 manufactured by KLA-Tencor. Sintered pads of this invention, having an average pore diameter of from about 5 microns to about 100 microns are able to polish tungsten wafers to give a polished wafer having a tungsten WIWNU of less than about 10%, preferably less than about 5%, and most preferably less than about 3%.

The term "tungsten WIWNU" refers to the WIWNU of a tungsten sheet or blanket wafer that has been polished with a polishing pad of this invention using an IPEC/Gaard 676/1 oracle machine for one minute with Semi-Sperse® W2000 Slurry manufactured by Cabot Corp. in Aurora, Ill. The machine was operated at a down force of 4 psi, an orbital speed of 280 rpm, a slurry flow rate of 130 mL/min, a delta P of −0.1 psi and an edge gap of 0.93 inches.

Another important parameter of the sintered polishing pad of this invention is known as waviness. Waviness ($W_t$) is a measure of the maximum peak to trough height of the surface waviness. The distance between the waviness peaks and troughs are greater than the distance between individual peaks and troughs which are measured to determine surface roughness. Thus, waviness is a measure of the uniformity of the surface contour of pads of this invention. Preferred polishing pads of this invention will have a surface waviness less than about 100 microns and most preferably less than about 35 microns.

A wide range of conventional thermoplastic resins may be used in the present invention provided that the resins may be formed into an open-celled substrate utilizing a sintering process. Useful thermoplastic resin include, for example, polyvinylchloride, polyvinylfluoride, nylons, fluorocarbons, polycarbonatc, polyester, polyacrylate, polyether, polyethylene, polyamide, polyurethane, polystyrene, polypropylene and the like and mixtures thereof. Typically, the resin is naturally hydrophilic or is capable of being rendered hydrophilic with the addition of a surfactant, dispersing aid or other suitable means. It is preferred that the thermoplastic resin used consists essentially of a thermoplastic resin polyurethane. A preferred urethane thermoplastic is Texin urethane thermoplastic manufactured by Bayer Corporation. Preferably the Texin urethane thermoplastic used are Texin 970u, and Texin 950u.

Using particular sizes (e.g. ultrafine, fine, medium, coarse, etc.) and shapes (e.g. irregular, spherical, round, flake, or mixtures and combinations thereof) of the thermoplastic resin particles, prior to sintering, is a useful way to vary the characteristics of the polymer matrix. When the thermoplastic resin particles are large, the particles may be ground to a powder of the desired particle size range using suitable size reduction techniques, such as mechanical grinding, jet-milling, ball-milling, screening, classifying and the like. When a blend of thermoplastic resins is used, it will be appreciated by those skilled in the art that the ratio of the components of the blend may be adjusted to achieve a desired pore structure in the finished product. For example, an increased percentage of the first component may be used to produce a product having a smaller pore size. Blending of the resin components can be achieved utilizing commercially available mixers, blenders and similar equipment.

In order to obtain the desired polishing pad physical properties, the particle size of the thermoplastic resin used in the sintering processes should range from about less than 50 to greater than 200 mesh, and more preferably between less than 80 and greater than 200 mesh. It is most preferred that essentially all of the thermoplastic resin particles have a size range that is less than 100 mesh and greater than 200 mesh. By "essentially all" it is meant that 95 wt % of the thermoplastic resin particles fall within a size range and most preferably 99% or more of the thermoplastic resin particles fall within the most preferred size range.

In one embodiment, when a lower density, less rigid substrate is desired, the synthetic resin particles chosen are highly irregular in shape. The use of irregularly shaped particles is believed to keep the particles from packing close together thereby providing a high void volume in the porous substrate, for example, 30% or greater. In another embodiment, when a higher density, stiffer polishing pad substrate is desired, the thermoplastic resin particles should be as close to spherical in shape as possible. In a preferred embodiment, the synthetic resin particles have a bulk Shore D hardness between 40 and 90.

Polishing pads/substrates of this invention, produced using thermoplastic resin particles in sintering processes, have been found to provide effective slurry control and distribution, polishing rates and quality (e.g. less defects, scratching, etc.) in CMP processes. In a preferred embodiment, the synthetic resin particles are polyurethane thermoplastic resin particles having an irregular or spherical shape and a bulk Shore D hardness between 45 and 75. Polishing pad substrates produced from such particles typically have a Shore A hardness between 55 to about 98, and preferably between 85 and 95. The polishing pad substrates have been found to exhibit acceptable CMP polishing rates and integrated circuit wafer surface quality.

It has also been found that an inter-relationship exists between the structure of the polishing pad and the ability to provide consistent and acceptable removal rates while minimizing pad induced defects and scratches. Important to such an interrelationship are the flow through vertical permeability and the amount of polishing slurry remaining on the polishing pad, as determined by the dynamic slurry capacity test, the procedure of which is set forth in Example 1. Flow through permeability is defined by the amount of polishing slurry flowing though the pad, as determined by the procedure also set forth in Example 1.

The polishing pads of the present inventions may be prepared utilizing conventional sintering techniques known to those skilled in the art using a continuous belt or closed mold process. One such closed mold technique is described in U.S. Pat. No. 4,708,839, the specification of which is incorporated herein by reference. Using a closed mold sintering process, a thermoplastic resin, such as polyurethane thermoplastic resin having the desired particle size (e.g. screened mesh size) and preferably a particle size of from less than 80 mesh to greater than 200 mesh, is placed in the bottom of a pre-shaped two piece mold cavity to the desired level. The thermoplastic resin may be optionally mixed or blended with a powdered surfactant prior to incorporation into the mold to improve the free-flow characteristics of the resin. The mold is closed and then vibrated to evenly spread the resin throughout the mold cavity. The mold cavity is then heated to sinter the particles together. The heat cycle for sintering the particles involves heating the mold evenly up to a pre-determined temperature over a pre-determined time period, maintaining the mold at a set temperature for an additional pre-determined time period, and then cooling the mold to room temperature over another predetermined time period. Those of ordinary skill in the art will appreciate that the thermal cycles can be varied to accommodate changes in the materials and molds. In addition, the mold can be heated using a variety of methods, including using microwaves, electrically or steam heated hot air ovens, heated and cooled platens, and the like. After sintering, the mold is cooled and the sintered polishing pad substrate is removed from the mold. Controlled modification of the thermal cycle may be used to alter the pore structure (size and porosity), degree of sintering, and other physical properties of the final polishing pad substrate material.

The preferred methods for manufacturing sintered polishing pad substrates of this invention will vary depending upon the size and physical properties of the desired of the polishing pad substrate. For purposes of describing the preferred sintering conditions, the polishing pad substrates will be divided into two sizes, "large pads" and "small pads." The term "large pad" refers to polishing pad substrates that have an outside diameter of more than 12 inches and up to 24 inches or more. The term "small pad" refers to polishing pad substrates having an outside diameter of about 12 inches or less.

All of the pads of this invention are prepared using thermoplastic resin compositions. The sintering methods used to manufacture polishing pad substrates of this invention will be described below in the context of using the preferred urethane thermoplastic in the sintering process.

Thermoplastics such as urethane are typically supplied as pellets. The preferred urethane thermoplastic, as supplied, typically has a pellet size ranging from about 1/8" to about 3/16". Prior to pad manufacture, the urethane elastomer is ground and preferably cryoground to a mean particle size of from less than 50 mesh and greater than 200 mesh and preferably to a particle size ranging from about less than 80 mesh to greater than 200 mesh. Once the desired particle size of the urethane thermopolymer is obtained, the particles may processed further by drying, by polishing or by any other method known to one of ordinary skill in the art.

It is preferred that the sized urethane resin particles are dried until they contain less than 1.0 wt % moisture and preferably until they contain less than about 0.05 wt % moisture prior to sintering for the manufacture of both large and small polishing pad substrates. For large pad manufacturing, it is also preferred that the ground particles are polished to remove sharp edges in order to reduce the pore volume and increase the density of the sintered polishing pad substrate.

As discussed above, standard thermoplastic sintering equipment is used to prepare the polishing pads of this invention. The size of the resulting polishing pad will depend upon the mold size. A typical mold is a two-piece mold manufactured out of stainless steel or aluminum that has a square or rectangular cavity ranging in size of from about 6 to about 36 inches in length and width and preferably from about 12 inches or about 24 inches in length and width. The mold sintering process is initiated by placing a measured amount of sized particulate urethane elastomer into the mold. The mold is then closed, bolted together, and vibrated for a period of time ranging from about 15 seconds to about 2 minutes or more to remove any void spaces between the urethane elastomer particles. The mold vibrating time will increase with increasing mold size. Therefore, it is expected that a 12 inch mold will be vibrated for a period of time ranging from about 15 seconds to about 45 seconds while a large 24 inch long mold will be vibrated for a period of time ranging from about 60 seconds to about 2 minutes or longer. The molds are preferably vibrated on their edges to insure proper packing of the particulate polymer material inside the mold cavity.

The charged vibrated mold is then heated at a desired temperature for a period of time sufficient to create a properly sintered polishing pad substrate. The mold should be heated to a temperature above the thermoplastic resin glass transition temperature to a temperature that approaches and possibly slightly exceeds the thermoplastic resin melting point. It is preferred that the mold be heated to a temperature of between 20° F. below to about 20° F. above the melting point of the thermoplastic resin used. Most preferably the mold should be heated to a temperature of from 20° F. below to a temperature about equivalent to the melting point temperature of the thermoplastic resin used in the sintering process.

The actual temperature chosen will, of course, depend upon the thermoplastic resin used. For example, with Texin 970u, the mold should be heated to and maintained at a temperature of from about 372° F. to about 412° F., and preferably from about 385° F. to about 392° F. It is also preferred that polishing pads manufactured according to this invention arc sintered at ambient pressures. In other words, no gaseous or mechanical methods need to be used to increase the pressure within the mold cavity to increase the density of the sintered thermoplastic product.

The mold should be heated in a horizontal position to allow a skin layer to form on the polishing pad substrate bottom surface during sintering. The mold should not be heated immediately to the desired temperature but it should be allowed to reach the desired temperature over a short period of time ranging from about 3 to 10 minutes or more and preferably within about 4 to 8 minutes from the beginning of the heating process. The mold should then be maintained at the target temperature for a period of time ranging from about 5 minutes to about 30 minutes or more and preferably for a period of time ranging from about 10 to about 20 minutes.

Upon completion of the heating step, the temperature of the mold is reduced steadily to a temperature of from about 70° F.–120° F. over a period of time ranging from about 2 minutes to about 10 minutes or more. The mold is then allowed to cool to room temperature whereupon the resulting polishing sintered pad substrate is removed from the mold.

The sintered pad of this invention may alternately be manufactured using a belt line sintering method. Such a method is described in U.S. Pat. No. 3,835,212, the specification of which is incorporated herein by reference. Typically, as the size of the polishing pad substrate becomes larger, it becomes more and more difficult to vibrate the mold in order to produce polishing pad substrates that have an appealing uniform visual appearance. Therefore the belt line sintering method is preferred for the manufacture of larger polishing pad substrates of this invention.

In the belt line sintering method, the properly sized and dried thermoplastic is charged evenly onto a smooth steel belt heated to a temperature of from about 40 to about 80° F. above the melting point temperature of the thermoplastic resin. The powder is unconfined on the plate and a belt holding the plate is drawn through a convection oven at a set rate which allows the polymer to be exposed to the target temperature for a period of time ranging from about 5 minutes to about 25 minutes or more and preferably for a period of time ranging from about 5 to 15 minutes. The resulting sintered polymer sheet is quickly cooled to room temperature and preferably reaches room temperature within from about 2 minutes to 7 minutes after exiting the oven.

Alternatively, the sintered polishing pads of this invention may be manufactured in a continuous closed mold process. Such a continuous closed-mold thermoplastic sintering process uses a mold that confines the top and bottom surfaces of the resulting pad but which does not confine the resulting pad edges.

Table 1 below summarizes the physical properties of sintered polishing pad substrates of this invention manufactured by the above-described sintering processes.

TABLE 1

| Property | Properly-Sintered | Optimum |
|---|---|---|
| Thickness - mils | 30–125 | 35–70 |
| Density - gm/cc | 0.5–0.95 | 0.70–0.90 |
| Pore Volume % - (Hg Porisimeter) | 15–70 | 25–50 |
| Average Pore Diameter ($\mu$) (Hg Porisimeter) | 1–1000 | 5–150 |
| Hardness, Shore A | 55–98 | 85–95 |
| Elongation to Break - % (12" Substrate) | 40–300 | 45–70 |
| Elongation to Break - % (24" Substrate) | 50–300 | 60–150 |
| Taber Abrasion (loss of mg/1000 cycles) | Less Than 500 | Less Than 200 |
| Compression Modulus - psi | 250–11,000 | 7000–11,000 |

TABLE 1-continued

| Property | Properly-Sintered | Optimum |
|---|---|---|
| Peak Stress - psi | 500–2,500 | 750–2000 |
| Air permeability - $ft^3/hr$ | 100–800 | 100–300 |
| Compressibility - % | 0–10 | 0–10 |
| Rebound % | 25–100 | 50–85 |
| Mean Top Surface Roughness* ($\mu$m) (Unbuffed) | 4–50 | 4–20 |
| Mean Top Surface Roughness* ($\mu$m) Post-Buffing | 1–50 | 1–20 |
| Average Bottom Skin Roughness* ($\mu$m) (unbuffed) | Less than 10 | 3–7 |
| Waviness (microns) | 100 | 35 |

*Measured using a portable profilometer.

The sintered polishing pad substrates of this invention have an unbuffed open pored top surface and a bottom surface skin layer. The bottom surface skin layer is less porous and as a result, smoother (less rough) than the unbuffed top surface. It is preferred that the polishing pad bottom surface skin layer has a surface porosity (i.e., the area of openings to the interior of the sintered pad on the unbuffed top pad surface), that is at least 25% less than the unbuffed pad top surface porosity. More preferably, the polishing pad bottom skin surface should have a surface porosity that is at least 50% less than the polishing pad top surface porosity. It is most preferred that the polishing pad bottom surface skin layer have essentially no surface porosity, i.e., less than 10% of the area of the polishing pad bottom skin consist of openings or pores that extend into the interior of the polishing pad substrate.

Figure 10:
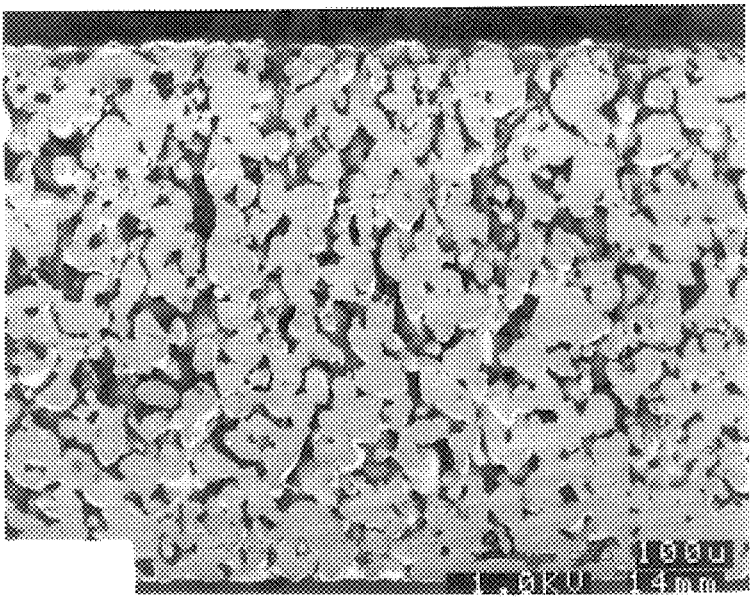
FIG. 10 is a SEM view of a cross section of a sintered polishing pad of this invention that was manufactured in a mold sintering process using urethane resin having a particle size ranging from about 200 mesh to about 100 mesh. The top of the pad is shown in the top of the micrograph while the bottom skin surface portion of the pad is orientated in the bottom of the SEM micrograph. The SEM micrograph was taken at 60×magnification.
Figure 11:
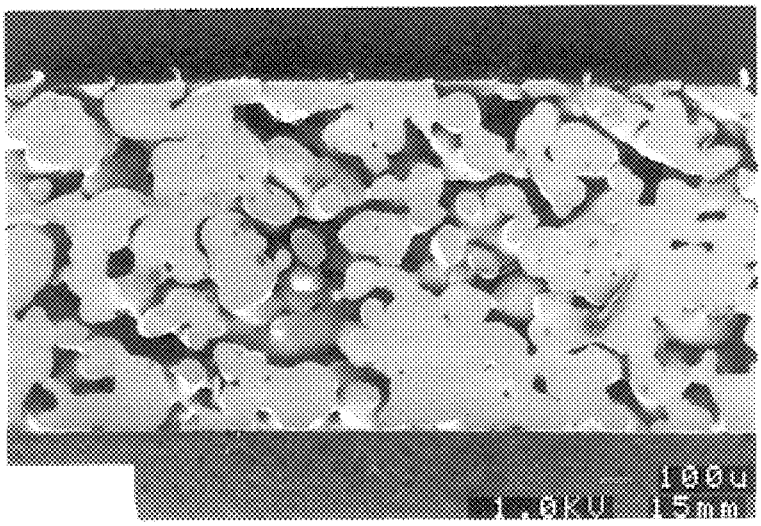
FIG. 11 is an SEM of a cross section view of a sintered urethane resin polishing pad of this invention that was manufactured by a belt sintering process using urethane particles having a particle size range of from less than 200 mesh to greater than 50 mesh wherein the SEM was taken at a 50×magnification.
Figure 12A:
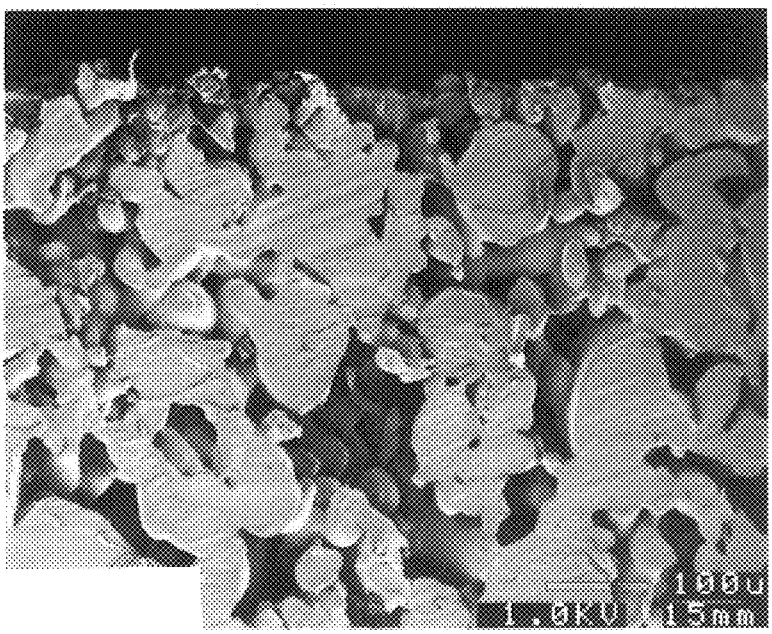
FIGS. 12A and 12B are side cross section views of the top portion of sintered urethane thermoplastic polishing pads of this invention which have had their top surfaces buffed. The SEM is at 150×magnification. The pads shown in FIGS. 12A and 12B were both manufactured by a belt sintering method using urethane thermoplastic particles having a size of from less than 200 mesh to greater than 50 mesh. The surface of the polishing pads were buffed using a wide belt sander using a less than 100 micron grit polyester-backed abrasive belt.
Figure 12B:
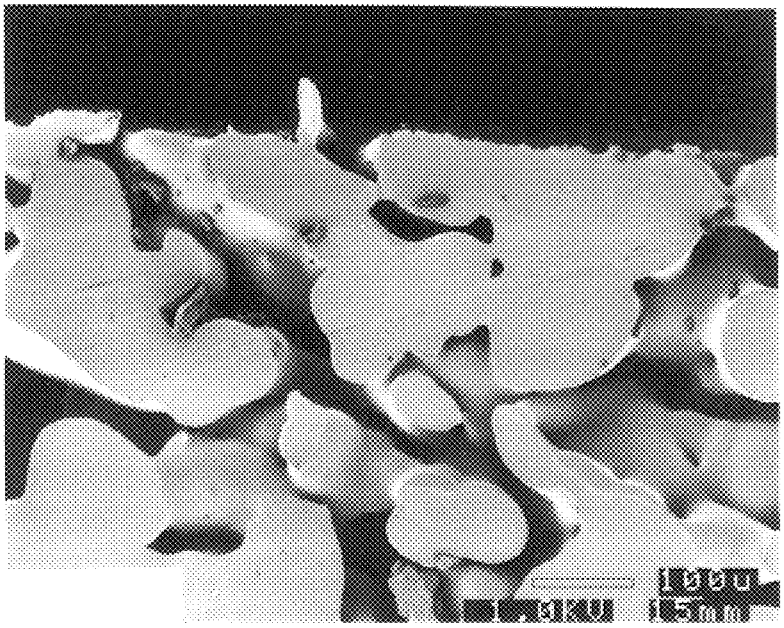
Figure 13A:
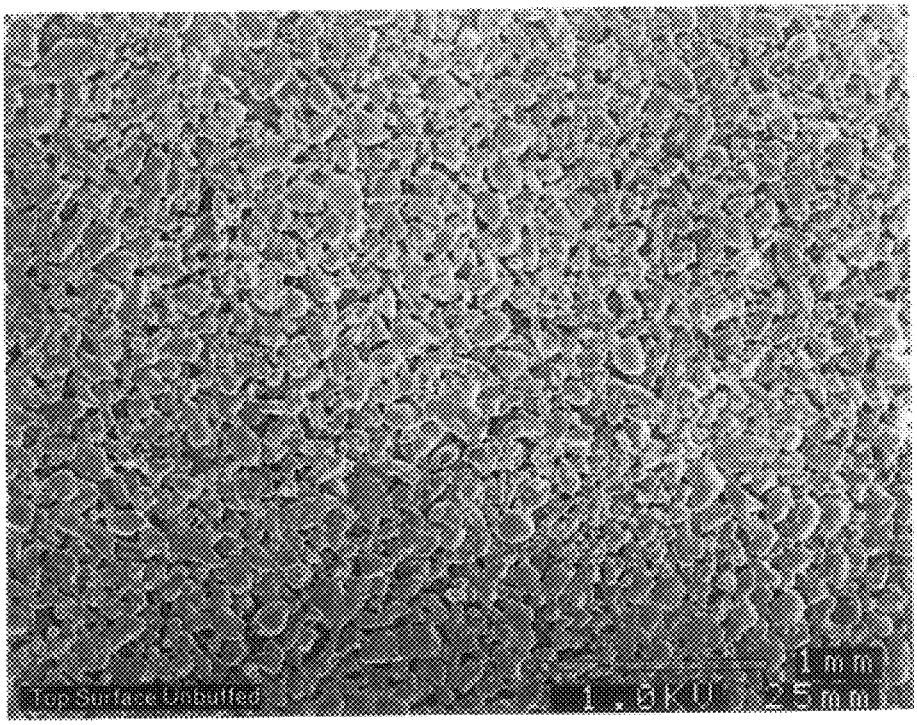
FIGS. 13A and 13B are overhead SEM views of the top surface and the bottom surface of a sintered urethane resin polishing pad of this invention that was manufactured by a mold sintering process using urethane particles having a particle size ranging of from about 200 mesh to about 100 mesh.
Figure 13B:
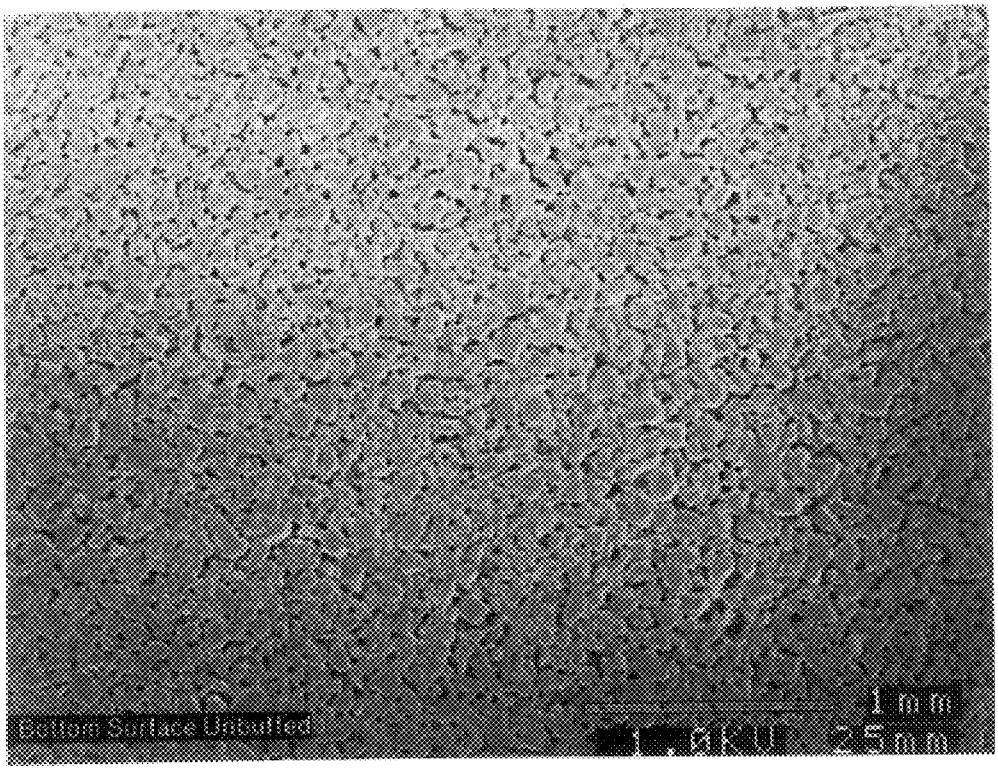

The pad bottom surface skin layer is created during the sintering process and occurs where the urethane elastomer contacts the bottom mold surface. The skin layer formation is most likely due to the higher localized sintering temperature at the bottom mold surface and/or due to the effect of gravity on the sintered particles or both. FIGS. 10–12 are cross section SEMs of sintered pads of this invention, each including an essentially closed pored bottom surface skin layer.

This invention includes polishing pad substrates including a bottom surface skin layer and also polishing pad substrates in which the bottom surface skin layer is removed. A polishing pad substrate that includes a bottom surface skin layer is useful for semiconductor manufacturing resulting in a polishing pad who's bottom surface is essentially impermeable polishing liquids.

The polishing pad substrates of this invention are manufactured into useful polishing pads by laminating an adhesive layer to the bottom surface skin layer of the pad substrate. The laminate preferably includes an adhesive and a removable backing. When the pad is associated with an adhesive laminate, the pad top surface is exposed, the adhesive layer is associated with the pad bottom surface skin layer, and the adhesive separates the backing material from the pad bottom surface skin layer. The backing material may be any type of barrier material that is useful in conjunction with an adhesive laminate including polymer sheets, paper, polymer coated paper, and combinations. It is most preferred that the laminate consists of a backing material covered by an adhesive layer, followed by a Mylar film layer which, in turn, is covered by a second adhesive layer. The second adhesive layer abuts the pad bottom surface skin layer. A most preferred laminate is 444PC or 443PC manufactured by the 3M Corporation.

The polishing pad is used by removing the protective paper layer to expose the adhesive. Thereafter the polishing pad is attached to a polishing machine by associating the exposed adhesive onto the surface of a polishing machine table or platen. The low surface porosity of the buffed or unbuffed polishing pad bottom surface inhibits polishing slurries and other liquids from permeating through the pad and contacting the adhesive layer thereby minimizing disruption of the adhesive bond between the polishing pad and the polishing machine surface.

Polishing pads of this invention may be associated with a polishing machine with or without the use of a sub-pad. A sub-pad is typically used in conjunction with a polishing pad to promote uniformity of contact between a polishing pad and an integrated circuit wafer that is undergoing CMP. If a sub-pad is used, is it located between the polishing pad table or platen and the polishing pad.

Before use, the sintered polishing pad may undergo additional conversion and/or conditioning steps, including for example, planarizing one or both surfaces of the substrate, critical cleaning to remove contaminants, de-skinning, texturing and other techniques known to those skilled in the art for completing and conditioning polishing pads. For example, the polishing pad may be modified to include at least one macroscopic feature such as channels, perforations, grooves, textures, and edge shapings. In addition, the polishing pad may further include an abrasive material, such as alumina, ceria, germania, silica, titania, zirconia, and mixtures thereof, for enhanced mechanical action and removal.

It is preferred that small polishing pad substrates include channels orientated in a checkerboard or other pattern across the pad top face having a distance from one another ranging from about ⅛" to ¾" and preferably ¼" apart. In addition, the channels should have a depth equivalent to approximately equal to about half the depth of the polishing pad substrate and a width ranging from about 20–35 mils and preferably about 25 mils. Polishing pads manufactured from large polishing pad substrates of this invention may optionally be surface modified with grooves, perforations and so forth.

Before use, the top pad surface is typically buffed in order to make the pad more absorbent to a polishing slurry. The pads may be buffed by any method used by those of ordinary skill in the art. In a preferred buffing method, the polishing pads of this invention are mechanically buffed using a belt sander with a belt having a grit size of from 25 to about 100 microns and preferably about 60 microns to give a polishing pad having a surface roughness (Ra) of less than about 20 $\mu$m and preferably from about 2 to about 12 $\mu$m. Surface roughness, $R_a$ is defined as the arithmetic mean of the absolute departures of the roughness profile.

The pad top surface buffing is usually performed on a polishing pad substrate prior to adhesive lamination. Following buffing, the polishing pads arc cleaned of debris and the bottom (non-polished surface) is treated by heat, corona, and like methods prior to laminating the pad bottom to a pressure sensitive adhesive laminate. The adhesive laminated pads may then be immediately used in a polishing machine or they may then be grooved or patterned as described above if they have not already been modified. Once the grooving and/or patterning processes, if any are undertaken, are complete, the pad is once again cleaned of debris and packaged in a clean package such as a plastic bag and stored for later use.

It is desirable to mechanically buff the bottom surface skin layer prior to applying an adhesive to the pad bottom surface. Buffing the bottom surface skin layer improves the adhesion of the adhesive to the pad resulting in a significant improvement in the pad/adhesive peel strength in comparison to pads with unbuffed bottom skin surfaces. Bottom surface buffing may be accomplished by any method that is capable of disturbing the integrity of pad bottom surface. Examples of useful buffing devices includes brushes with stiff bristles, sanders and belt sanders with a belt sander being preferred. If a belt sander is used to buff the pad bottom surface, then the paper used in the sander should have a grit less than about 100 microns. In addition, the pad bottom surface may be buffed once or more than once. In a preferred embodiment, sintered polishing pad of this invention including a buffed bottom surface will have a bottom buffer surface porosity that is less than the surface porosity of the pad top surface.

Following buffing, the buffed pad top and bottom surfaces are each cleaned with a brush/vacuum device. After vacuuming, the vacuumed surfaces are blown with pressurized air to remove most of the remaining particles from the buffed surfaces.

Immediately prior to use, CMP polishing pads are typically broken-in by applying a CMP slurry to the pads and thereafter exposing the pads to polishing conditions. Examples of useful polishing pad break-in methods are described in U.S. Pat. Nos. 5,611,943, and 5,216,843, the specifications of which are incorporated herein by reference.

This invention also encompassed methods for polishing the surface of an article which comprises the steps of contacting at least one polishing pad of the present invention with the surface of the article in the presence of a polishing slurry and removing a desired portion of said surface by moving said pad in relation to said surface, or alternative moving the article platform in relation to the pad. The polishing pads of the present invention may be used during the various stages of IC fabrication in conjunction with conventional polishing slurries and equipment. Polishing is preferably performed in accordance with standard techniques, particularly those described for CMP. In addition, the polishing pads may be tailored to polish a variety of surfaces including metal layers, oxide layers, rigid or hard disks, ceramic layers and the like.

As noted above, the polishing pad of the present invention may be useful in a wide variety of polishing applications and, in particular, chemical mechanical polishing applications to provide effective polishing with minimum scratching and defects. As an alternative to conventional polishing pads, the polishing pad of the present invention may be used on a variety of polishing platforms, assures controllable slurry mobility; and provides quantifiable attributes directly affecting polishing performance and control of the manufacturing process for specific applications.

The foregoing description of preferred embodiments of the invention has been presented for purposes of illustration and description. It is not intended to be exhaustive or to limit the invention to the precise form disclosed, and modifications and variations are possible in light of the above teachings, or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

EXAMPLES

The following procedures were used to determine polishing pad properties throughout the Examples.

Flow Through Vertical Permeability: Slurry flow rate through a polishing pad was measured using a vacuum filtration apparatus available from Fischer Corporation. The apparatus consisted of an upper liquid reservoir, a neck for attaching a vacuum line, and a lower liquid reservoir to collect the liquid, i.e. slurry, and was used without any vacuum. The diameter of the upper and lower reservoirs was about 3.55". A ⅜" hole was drilled in the center of the bottom surface of the upper reservoir. To measure the slurry flow rate, a polishing pad substrate having a diameter of 3.5" was placed at the bottom of the upper reservoir and an O-ring was placed between pad and the upper reservoir walls. A cylindrical plastic vessel, open at both ends, was then place firmly on the top of the pad to prevent any liquid from seeping around the pad surface. Approximately 100 grams of liquid was poured into the cylindrical vessel at a rate of 25 gm/s for 4 seconds. The amount of liquid collected by the lower reservoir was weighed. The slurry flow rate was calculated by dividing the weight of the collected liquid by time (300 seconds).

Dynamic Slurry Capacity Test: The polishing pad substrate polishing slurry capacity was determined by the dynamic slurry capacity test, which is performed by placing a pad of 3.5" diameter on a liquid reservoir cup having a diameter of 3.4" . The pad and reservoir cup was placed in the center of a larger open container which, in turn, was placed on top of the platen of a Hyprez II polisher (manufactured by Engis Corporation). To measure the slurry remaining on the polishing pad, liquid was distributed onto the top surface of the polishing pad, rotating at a predetermined speed, at its center at varying flow rates using a peristaltic pump. "Flow through" was determined by measuring the amount of liquid that actually permeated through the polishing pad. "Flow over the pad" was the amount of liquid that swept over the pad and was collected in the larger open container. The "amount of slurry remaining on the pad" was calculated by subtracting the weight of the pad prior to the addition of the slurry from the weight of the pad after the addition of the slurry.

Pore Size Measurements: The pore size measurements were determined using a ruler or by using a mercury porosimeter.

Shore D and Shore A Measurements: Shore D and Shore A hardness measurements were made in accordance with the procedures set forth in ASTM No. D2240.

Slurry Capacity Method: The slurry capacity method consists of immersing 1×4 inch samples of a pad substrate in a bath of CMP slurry at room temperature (25° C.) for 12 hours. The pad samples were pre-weighed dry before they were placed in the slurry. The pad samples are taken out of the slurry bath after 12 hours and the excess slurry on the surface of the pad was removed by blotting. The pad samples were then weighed again to determine the wet weight of the pad. The difference between the wet weight and the dry weight divided by the dry weight yields the slurry capacity for each pad sample. The slurry capacity value is multiplied by 100 to give the percent slurry capacity.

EXAMPLE 1

Samples of commercial Texin polyurethane materials having varying bulk Shore D hardness values and of varying mesh sizes were frozen to brittleness and cryogenically ground into particles and later classified by screening as fine mesh (F) and medium mesh (M). Toxin polyurethane later classified by screening as coarse mesh (C) was not ground. The grinding step produced irregular, spherical, or substantially flat shaped powders. The fine mesh (F) is characterized as having a mesh size finer than 100 mesh, the medium mesh (M) particles are defined as having a mesh size finer than 50 and coarser than 100 mesh, while the course mesh material is characterized as having a mesh size coarser than 50 mesh. The polyurethane having a Shore D Hardness of 70 was Texin 970u and the polyurethane material having a Shore D Hardness of 50 was Texin 950u.

The screened powders were placed in the bottom of a two-piece mold. The amount of powder on the bottom of the mold was not critical, but was sufficient to completely cover the bottom of the mold cavity. The cavity was then vibrated to spread the powders evenly over the bottom surface and ensure complete coverage of the cavity. The mold was then heated utilizing a conventional sintering process, typically to a temperature above the Texin glass transition temperature (about 32° F.) but below the melting point of the polyurethane (about 392° F.), to sinter the particles. The actual sintering conditions were determined separately for each lot of thermoplastic resin since Tg and melting point temperatures varied from lot to lot. After sintering, the mold was cooled and the porous substrate was removed from the mold for further processing and conversion into a polishing pad. The substrates had a bottom surface skin layer formed from the bottom of the mold, any varying average pore sizes and Shore A hardness values.

The porous substrates were cut into circular polishing pads 12" in diameter. The average pad thickness was approximately 0.061". The pads top surfaces were buffed using a commercially available hand sander with 150 micron grit particle belt to ensure that the top pad surface was parallel to the bottom surface. The bottom surfaces of the pads were then designed to improve wettability using a conventional orbital hand sander having a 150 grit $Al_2O_3$ paper. The bottom surface of the pad was attached to the lip of the liquid reservoir that captures the slurry that passes through the pad with a ⅛" strip of 3M Brand 444PC adhesive. The flow through vertical permeability and the amount of polishing slurry remaining on the pad were measured at various slurry flow rates utilizing the procedures set forth in the Example introduction. The test results and other polishing pad characteristics are set forth in Table 2 below.

TABLE 2

| Sample | Shore D Hardness of Synthetic Resin Particles | Size* | Pore Average Size (μm) | Slurry Flow (ft/min) | Vertical Permeability | Liquid Remaining On Pad |
|---|---|---|---|---|---|---|
| 1 | 70 | F | 50 | 1.8 | 5.6 | 18.6 |
| 1 | 70 | F | 50 | 3.8 | 11.7 | 16.8 |
| 1 | 70 | F | 50 | 7.3 | 9.9 | 15.4 |
| 1 | 70 | F | 50 | 14.6 | 0.2 | 4.0 |
| 2 | 50 | F | 100 | 1.8 | 0 | 15.4 |
| 2 | 50 | F | 100 | 3.8 | 0 | 9.0 |
| 2 | 50 | F | 100 | 7.3 | 0 | 7.3 |
| 2 | 50 | F | 100 | 14.6 | 0 | 1.0 |
| 3 | 50 | M | 250 | 1.8 | 112.8 | 1.7 |
| 3 | 50 | M | 250 | 3.8 | 114.8 | 0.6 |
| 3 | 50 | M | 250 | 7.3 | 112.4 | 1.7 |
| 3 | 50 | M | 250 | 14.6 | 37.4 | 2.2 |
| 4 | 70 | C | 300–350 | 1.8 | 103.2 | 1.6 |
| 4 | 70 | C | 300–350 | 3.8 | 67.3 | 4.3 |
| 4 | 70 | C | 300–350 | 7.3 | 16.7 | 5.4 |
| 4 | 70 | C | 300–350 | 14.6 | 6.1 | 1.8 |

As indicated in Table 2, synthetic resins of varying bulk Shore D hardness and mesh sizes may be used to yield useful polishing pad substrates. It is contemplated within the scope of the invention that the polishing pad properties may be tailored depending on the particular polishing platform, the wafer/substrate being polished, and the type of polishing slurry being used. In addition, it is recognized that additional macroscopic features, such as perforations, channels or grooves, may be necessary to achieve a polishing pad possessing the desired flow through permeability.

Preliminary polishing studies using the polishing pad Samples 2 and 3 were performed on a Struers Roto-Force 3 Table-Top Polisher (available from Struers Division, Radiometer America Inc., Westlake, Ohio) to simulate actual industry polishing conditions. The polishing pad was affixed onto the polisher with the double-sided adhesive. The surface of the pad was wet with deionized water to start the wet conditioning process and, thereafter, the surface of the pad was saturated until the pad was broken in. The polishing pads of the present invention were used to chemically-mechanically polish a tungsten barrier layer on a wafer having a tungsten thickness of approximately 8000 Å using Semi-Sperse® W-A355, an alumina based polishing slurry manufactured by Cabot Corporation, Aurora, Ill. The slurry was delivered onto a pad using a peristaltic pump (available from Masterflex, Model 7518-60) to simulate actual slurry delivery at a flow rate of 100 ml/min. The tungsten removal rate and other relevant properties are set forth in Table 3. For comparative purposes, commercially available polishing pads were also used to polish the tungsten layer over thermal oxide under the same polishing conditions set forth above. The tungsten removal rate and other relevant properties are also set forth in Table 3.

TABLE 3

| Polishing Pad | Tungsten Removal Rate (Å/min) |
|---|---|
| Sample 2 | 5694 |
| Sample 3 | 4862 |
| Comparative Pad - Thomas West P777 | 6805 |
| Comparative Pad - Freudenberg Pan W | 3292 |
| Comparative Pad - Rodel Suba ™ 500 (Embossed) | 1224 |
| Comparative Pad - Rodel Politex ® (Embossed) | 4559 |

As noted in Table 3, the polishing pads of the present invention provided consistent and acceptable tungsten removal rates while minimizing pad induced defects and scratches. In addition, the polishing pads of the present invention allow for the control of several pad physical properties related to pad polishing performance including polishing pad substrate porosity, slurry flow, surface roughness, mechanicals and the like. As a result, the polishing pads of this invention provided an effective alternative to commercially available pads by offering acceptable CMP removal rates and finished surfaces.

EXAMPLE 2

Further representative examples of another embodiment of polishing pads of the present invention were manufactured utilizing the procedure set forth in the specification and in Example 2. As in Example 2, the starting synthetic resin particles had varying Shore D Hardness and mesh sizes. Relevant pad characteristics and properties were measured at three intervals—before buffing, following buffing and after break-in. The pad characteristics are set forth in Tables 4, 5, 6 and 7.

TABLE 4

| Pad Property* | Pre-Buff. Condition | Post-Buff Condition | Post-Break-In |
|---|---|---|---|
| Thickness (inch) | 0.050 ± 0.002 | 0.049 ± 0.002 | 0.0553 ± 0.0026 |
| Shore Hardness A | 90 ± 1.04 | 89 ± 1.09 | 90 ± 3.01 |
| Density (g/cc) | 0.78 ± 0.042 | 0.76 ± 0.04 | 0.69 ± 0.033 |
| Compressibility (%) | 4.7 ± 1.7 | 2.7 ± 0.89 | 4.1 ± 0.71 |
| Rebound (%) | 54 ± 15.7 | 54.8 ± 16.64 | 39 ± 7.97 |
| COFk | 0.40 ± 0.02 | 0.44 ± 0.009 | 0.58 ± 0.015 |
| Mean Top Surface Roughness (μm) | 15.6 ± 1.3 | 16.1 ± 1.8 | 6.8 ± 0.82 |
| Pore Size (microns) | 32.65 ± 1.71 | | |
| Pore Volume (%) | 34.4 ± 3.12 | | |
| Air Permeability ($ft^3$/hr) | 216.67 ± 49.67 | | |
| Elongation to Break (%) | 93.5 | | |
| Peak Stress (psi) | 991.5 | | |

*Pad made from Texin 950 u urethane thermoplastic having a Shore D Hardness of 50 and Fine Mesh Size.

TABLE 5

| Pad Property* | Pre-Buff Condition | Post-Buff Condition | Post-Break In |
|---|---|---|---|
| Thickness (inch) | 0.073 ± 0.002 | 0.070 ± 0.007 | 0.072 ± 0.0007 |
| Shore Hardness A | 76 ± 2.3 | 77 ± 2.9 | 84.2 ± 1.2 |
| Density (g/cc) | 0.61 ± 0.040 | 0.63 ± 0.02 | 0.61 ± 0.006 |
| Compressibility (%) | 7.0 ± 3.8 | 3.5 ± 0.74 | 2.4 ± 0.69 |
| Rebound (%) | 73 ± 29.4 | 67.4 ± 7.74 | 59 ± 14.54 |
| COFk | 0.47 ± 0.02 | 0.63 ± 0.01 | 0.53 ± 0.003 |
| Mean Top Surface Roughness (μm) | 29.3 ± 4.6 | 33.6 ± 3.64 | 23.5 ± 2.3 |
| Pore Size (microns) | 83.5 ± 4.59 | | |
| Pore Volume (%) | 46.7 ± 1.85 | | |
| Air Permeability ($ft^3$/hr) | 748.3 ± 27.1 | | |
| Elongation to Break (%) | 28.2 | | |
| Peak Stress (psi) | 187.4 | | |

*Pad made from Texin 950 u urethane thermoplastic having a Shore D Hardness of 50 and Medium Mesh Size.

TABLE 6

| Pad Property* | Pre-Buff Condition | Post-Buff Condition | Post-Break In |
|---|---|---|---|
| Thickness (inch) | 0.042 ± 0.003 | 0.041 ± 0.003 | 0.040 ± 0.0027 |
| Shore Hardness A | 93 ± 0.84 | 87 ± 0.74 | 94.6 ± 0.69 |
| Density (g/cc) | 0.86 ± 0.60 | 0.87 ± 0.06 | 0.89 ± 0.059 |
| Compressibility (%) | 3.4 ± 0.79 | 3.2 ± 1.5 | 6.5 ± 1.5 |
| Rebound (%) | 77 ± 18.30 | 46 ± 20.3 | 35 ± 8.67 |
| COFk | 0.26 ± 0.01 | 0.46 ± 0.009 | 0.71 ± 0.091 |
| Mean Top Surface Roughness (μm) | 13.0 ± 1.7 | 11 ± 0.0 | 4.0 ± 0.69 |
| Pore Size (microns) | 22.05 ± 2.47 | | |
| Pore Volume (%) | 40.7 ± 2.14 | | |
| Air Permeability ($ft^3$/hr) | 233.3 ± 57.85 | | |
| Elongation to Break (%) | 77.8 | | |
| Peak Stress (psi) | 503.4 | | |

*Pad made from Texin 970 u urethane thermoplastic having a Shore D Hardness of 70 and Fine Mesh Size.

TABLE 7

| Pad Property* | Pre-Buff Condition | Post-Buff Condition | Post-Break In |
|---|---|---|---|
| Thickness (inch) | 0.063 ± 0.002 | 0.058 ± 0.004 | 0.058 ± 0.0017 |
| Shore Hardness A | 81 ± 1.5 | 88 ± 0.54 | 92 ± 0.77 |
| Density (g/cc) | 0.74 ± 0.02 | 0.79 ± 0.02 | 0.78 ± 0.023 |
| Compressibility (%) | 6.5 ± 2.3 | 2.9 ± 0.05 | 3.5 ± 2.2 |
| Rebound (%) | 77 ± 12.7 | 65 ± 14.0 | 6.5 ± 26.52 |
| COFk | 0.61 ± 0.03 | 0.46 ± 0.02 | 0.61 ± 0.55 |
| Mean Top Surface Roughness (μm) | 38.7 ± 7.4 | 31 ± 4.4 | 15.7 ± 2.8 |
| Pore Size (microns) | 61.73 ± 5.13 | | |
| Pore Volume (%) | 33.56 ± 1.85 | | |
| Air Permeability ($ft^3$/hr) | 518.3 ± 174.2 | | |
| Elongation to Break (%) | 50.5 | | |
| Peak Stress (psi) | 572.1 | | |

*Pad made from Texin 970 u urethane thermoplastic having a Shore D Hardness of 70 and Medium Mesh Size.

TABLE 8

| Properties (Avg. values) | Pre-Buff Condition Pad A* | Post-Buff Condition Pad A* | Pre-Buff Condition Pad B* | Post-Buff Condition Pad B* |
|---|---|---|---|---|
| Thickness (inches) | 0.0531 ± 0.0003 | 0.0525 ± 0.004 | 0.0535 ± 0.004 | 0.0523 ± 0.0003 |
| Density (g/cc) | 0.7753 ± 0.0037 | 0.7887 ± 0.0060 | 0.7857 ± 0.0061 | 0.7909 ± 0.0045 |
| Surface Roughness (Ra) (Microns) | 11.3 ± 1.3614 | 7.8 ± 0.9381 | 11.05 ± 1.473 | 7.05 ± 0.8062 |
| Shore A Hardness | 92 ± 0.000 | 92 ± 0.0000 | 93 ± 0.5774 | 92 ± 0.0000 |
| Peak Stress (psi) | 942.59 | 855.390 | 937.35 | 945.851 |
| Break at Elongation (%) | 71.2 | 63.2 | 68.1 | 68.1 |
| Compressive Modulus (psi) | 9198 ± 55.30 | 9219.4 ± 73.234 | 9243 ± 63.54 | 9057 ± 157.7 |
| Flexural Rigidity (psi) | 291.901 | 235.078 | 241.698 | 224.221 |
| Taber Abrasion (wt. Loss in grams) | 0.1681 | 0.1807 | 0.1917 | 0.1534 |

*Pads A and B made from Texin 970 u urethane thermoplastic having a Shore D Hardness of 70 and Fine Mesh Size.

The results above show that polishing pad top surface roughness is improved by buffing and then by break-in.

EXAMPLE 3

A sintered polishing pad substrate manufactured from fine Texin 970u urethane thermopolymer was prepared in accordance with the method described for preparing Sample 1 of Example 1. The polishing pad substrate was evaluated with the bottom surface skin layer intact for slurry capacity and slurry flow-through rate. The slurry flow through rate was measured according to the methods set forth in the Example introduction. The slurry capacity method is also described in Example introduction.

The unconditioned pad had a slurry flow-through rate of 0 grams per second and a slurry capacity of 4.7%. It is believed that the slurry flow-through rate was 0 because the polishing pad substrate top surface is hydrophobic prior to buffing and repels water containing slurries. The top surface of the pad was thereafter conditioned according to the buffing method described in Example 1. The buffing step mechanically conditions the top pad surface and converts the top pad surface from hydrophobic to hydrophilic. The buffed pad thereafter exhibited a slurry flow rate of 0.234 grams per second and a slurry capacity of 5.3%. Next, the bottom surface of the same pad was buffed and broken-in according to the methods set forth in Example 1. Thereafter, the pad exhibited a slurry flow rate of 0.253 grams per second and a capacity of 5.7%.

These results indicate that buffing the top surface of the polishing pad improves the slurry capacity and the pad flow-through by converting the pad surface character from hydrophobic to hydrophilic.

EXAMPLE 4

Figure 14:
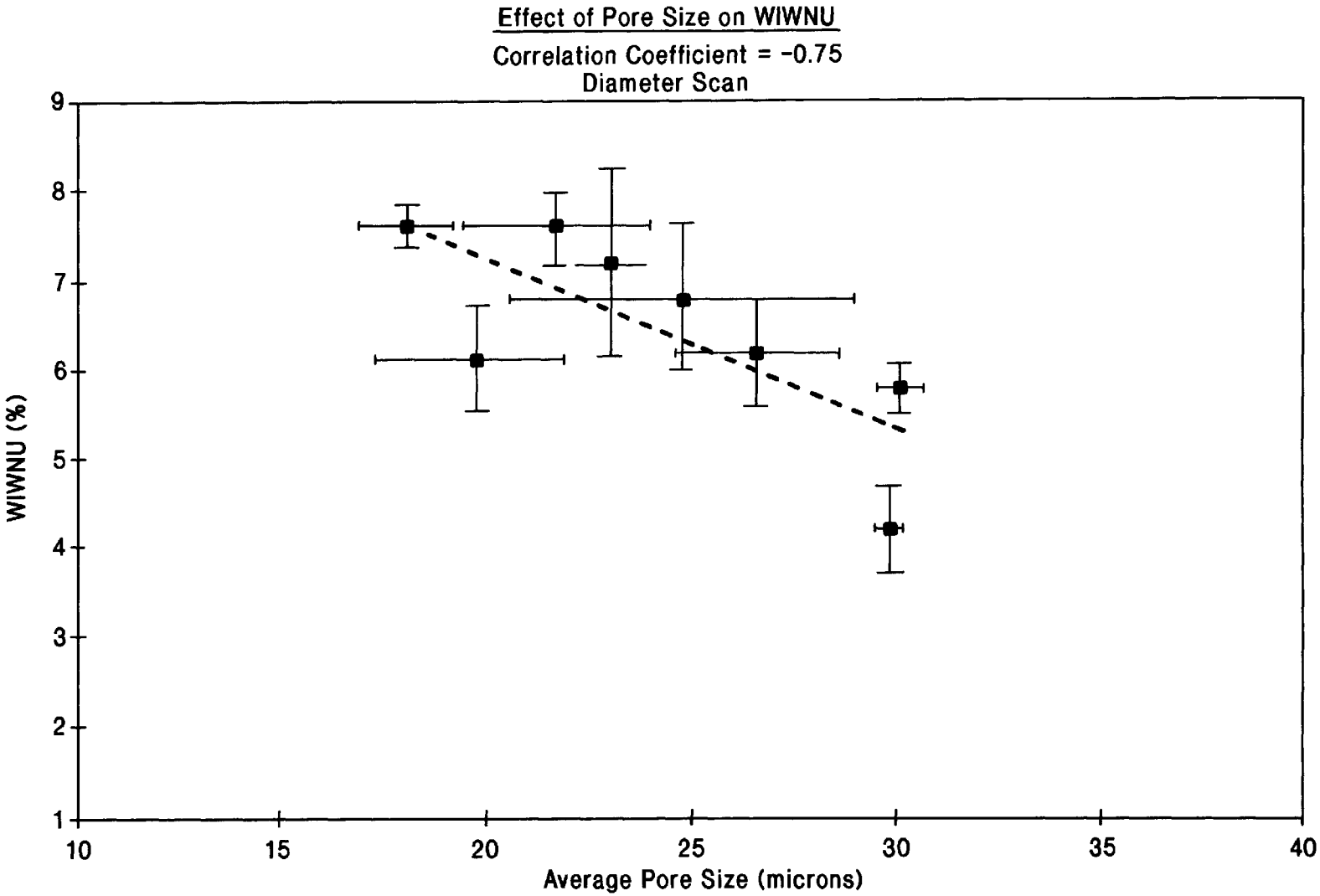
FIG. 14 is a plot showing the effect of sintered urethane pad average pore diameter on tungsten wafer uniformity following polishing wherein the X-axis is average pad pore diameter in microns and the Y-axis represents tungsten wafer within wafer non-uniformity (WIWNU) in percent.
Figure 15:
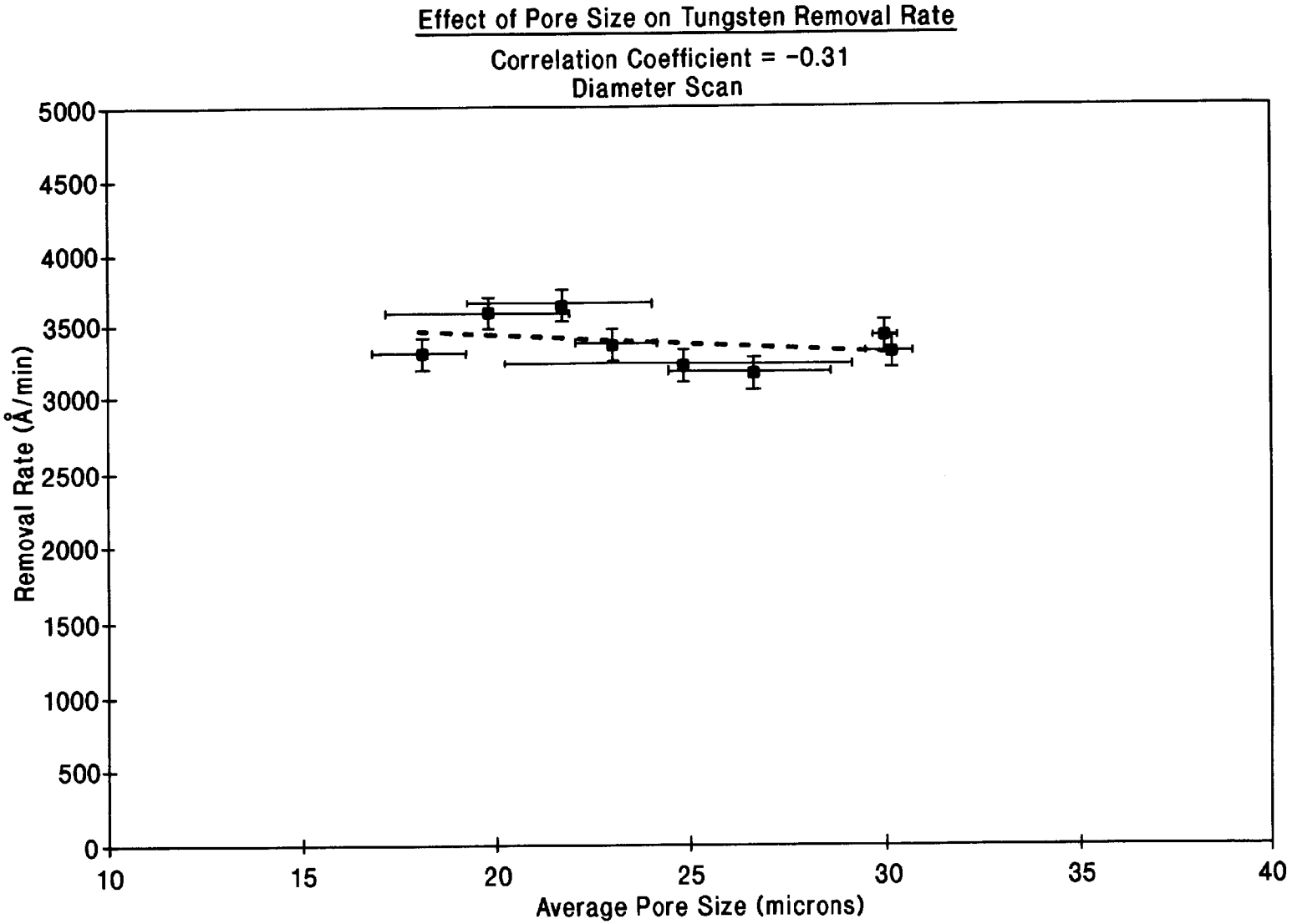
FIG. 15 is a plot of tungsten wafer tungsten removal rate for several sintered urethane polishing pads having varying average pore diameters where the X-axis represents the average pad pore diameter in microns and the Y-axis represents the tungsten removal rate in Å/min.

This Example describes the relationship between pad average pore diameter and polished tungsten wafer surface defectivity. Urethane resin polishing pads were prepared according to the method described in Example 1. Average pad pore diameters were determined by randomly selecting a sub-lot of 4–9 pads from a lot of pads produced on the same day. The average pore diameter was calculated for each pad in the 4–9 pad sub-lot (except that only 1 pad was used for the 21 micron pore diameter point) and an average sub-lot pore volume was calculated and used for plotting purposes in FIGS. 14–15. A single pad from each sub-lot was randomly selected for polishing. In all, eight pads, having average pore diameters ranging from about 18 to about 30 microns were used for tungsten wafer polishing.

The representative pads were evaluated for their ability to polish tungsten blanket wafers using a IPEC/Gaard 676/1 oracle machine for one minute with Semi-Sperse® W2000 slurry manufactured by Cabot Corp. in Aurora, Ill. The machine was operated at a down force of 4 psi, an orbital speed of 280 rpm, a slurry flow rate of 130 mL/min, a delta P of −0.1 psi and an edge gap of 0.93 inches.

The tungsten wafer WIWNU and tungsten polishing rate was determined for each pad and plotted against pad average pore diameter. The two plots are found at FIGS. 14–15.

The tungsten wafer polishing results show that tungsten WIWNU improves with increasing pad average pore diameter while tungsten wafer polishing rate remains essentially unaffected.

EXAMPLE 5

The effect of buffing the pad bottom surface on pad/adhesive peel strength was evaluated in this Example.

Pads were prepared according to Example 1. The pad surfaces were buffed with 2 passes (180 degree rotation after first pass) on a standing belt sander manufactured by Burlington Sanders using 0, 2 or 6 buffing passes, 50 grit size paper, a tool gap of −5 mils and conveyer speed of 10 ft/min. The peel strength of the unbufffed pad, and buffed pads are reported in Table 9, below.

TABLE 9

| Treatment of Pad before adhesion application | Peel Strength |
|---|---|
| No buff | 0.54 lbf/in |
| 2 pass buff | 1.76 lbf/in |
| 6 pass buff | 1.47 lbf/in |

Buffing the bottom surface of the pads improved pad peel strength with a 2 pass buff yielding the highest peel strength.

What is claimed is:

1. A polishing pad substrate comprising sintered particles of thermoplastic resin, wherein said polishing pad substrate has an average pore size of from about 5 microns to about 100 microns.

2. The polishing pad substrate of claim 1, having a tungsten WIWNU less than about 10% and a tungsten polishing rate greater than about 2000 Å.

3. The polishing pad substrate of claim 1 having a tungsten WIWNU less than about 5% and a tungsten polishing rate greater than about 2500 Å.

4. The polishing pad substrate of claim 1 having a tungsten WIWNU less than about 3% and a tungsten polishing rate greater than about 2500 Å.

5. The polishing pad of claim 1, wherein said thermoplastic resin is polyvinylchloride, polyvinylfluoride, nylon, fluorocarbon, polycarbonate, polyester, polyacrylate, polyether, polyethylene, polyamide, polyurethane, polystyrene, polypropylene, and copolymers and mixtures thereof.

6. The polishing pad substrate of claim 1 wherein the thermoplastic resin is urethane resin.

7. The polishing pad substrate of claim 1 wherein the pad has a waviness less than about 100 microns.

8. The polishing pad substrate of claim 1 wherein the pad has a waviness less that about 35 microns.

9. A sintered urethane resin polishing pad substrate having a top surface, a bottom surface including a skin layer, wherein said substrate has a thickness of from 30–125 mils, a density of from 0.60 to 0.95 gm/cc, a pore volume of from 15–70%, and an average pore size of from about 5 microns to about 100 microns and a waviness less than about 100 microns wherein the pad has a tungsten WIWNU less than about 8% and a tungsten polishing rate greater than about 2000 Å.

10. A polishing pad comprising;

a. a polishing pad substrate further comprising sintered particles of thermoplastic resin, wherein said polishing pad substrate has a top surface having a mean unbuffed surface roughness and a bottom surface including a skin layer having a mean unbuffed surface roughness, wherein the pad top surface mean unbuffed surface roughness is greater than the mean unbuffed surface roughness of the pad bottom surface and wherein the pad has an average pore size of from about 10 microns to about 70 microns and a waviness of less than about 100 microns;

b. a backing sheet; and c. an adhesive located between the backing sheet and the bottom surface skin layer.

11. The polishing pad of claim 10 including at least one macroscopic feature selected from channels, perforations, grooves, textures, and edge shapings.

12. The polishing pad substrate of claim 10 wherein the polishing pad has a density of from 0.50 to 0.95 gm/cc.

13. The polishing pad substrate of claim 10 wherein the polishing pad has a pore volume of from 15–70%.

14. The polishing pad of claim 10, wherein said thermoplastic resin is polyvinylchloride, polyvinylfluoride, nylon, fluorocarbon, polycarbonate, polyester, polyacrylate, polyether, polyethylene, polyamide, polyurethane, polystyrene, polypropylene, and copolymers and mixtures thereof.

15. The polishing pad substrate of claim 10 wherein the thermoplastic resin is urethane resin.

16. The polishing pad substrate of claim 10 having a tungsten WIWNU less than about 10% and a tungsten polishing rate greater than about 2000 Å.

17. The polishing pad substrate of claim 10 having a tungsten WIWNU less than about 3% and a tungsten polishing rate greater than about 2500 Å.

18. A polishing pad comprising;

a. a sintered urethane resin polishing pad substrate having a top surface, a bottom surface including a skin layer, wherein said substrate has a thickness of from 30–125 mils, a density of from 0.60 to 0.95 gm/cc, a pore volume of from 15–70%, a mean top surface roughness of from 1–50 microns, an average pore diameter of from about 10 to about 70 microns, a waviness less than about 35 microns, a mean bottom surface skin layer roughness of less than 20 microns wherein the mean surface roughness of the bottom surface skin layer is less than the mean surface roughness of the top surface, a tungsten WIWNU less than about 5% and a tungsten polishing rate greater than about 2000 Å;

b. a backing sheet; and c. an adhesive located between the backing sheet and the bottom surface skin layer.

* * * * *